US006739650B2

(12) United States Patent
Bartlett

(10) Patent No.: US 6,739,650 B2
(45) Date of Patent: May 25, 2004

(54) ELECTRIC OPENER FOR FURNITURE RECLINER MECHANISM

(75) Inventor: William E. Bartlett, Shelbyville, KY (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/391,682

(22) Filed: Mar. 19, 2003

(65) Prior Publication Data

US 2004/0080191 A1 Apr. 29, 2004

Related U.S. Application Data

(60) Provisional application No. 60/421,539, filed on Oct. 25, 2002.

(51) Int. Cl.[7] ..... A61G 15/00
(52) U.S. Cl. ..... 297/84
(58) Field of Search ..... 297/83, 84, 85

(56) References Cited

U.S. PATENT DOCUMENTS 2,714,922 A * 8/1955 McKibban et al. ..... 297/83
3,588,170 A * 6/1971 Knabusch et al. ..... 297/69
4,365,836 A * 12/1982 Jackson et al. ..... 297/85
4,386,803 A * 6/1983 Gilderbloom ..... 297/84
4,696,512 A * 9/1987 Burnett et al. ..... 297/68
5,265,935 A * 11/1993 Geisler et al. ..... 297/325
5,271,660 A * 12/1993 LaPointe et al. ..... 297/85
6,227,563 B1 * 5/2001 Talisman ..... 280/735

* cited by examiner

*Primary Examiner*—Milton Nelson, Jr.
(74) *Attorney, Agent, or Firm*—Shook, Hardy & Bacon L.L.P.

(57) ABSTRACT

A chair movable between an upright, stowed position and a reclined, extended position, comprising a seat, a back, an ottoman, a recliner linkage, and an electric solenoid driven release mechanism. The recliner linkage couples the ottoman to the chair. The recliner linkage is adapted to move the ottoman between the upright stowed position and the reclined, extended position. The electric solenoid driven release mechanism has a member in contact with the recliner linkage and when activated moves the ottoman linkage beyond the release point. Once the recliner linkage moves beyond the release point the chair moves from the upright position to the recliner position.

16 Claims, 2 Drawing Sheets

ELECTRIC OPENER FOR FURNITURE RECLINER MECHANISM

CROSS-REFERENCE TO RELATED APPLICATIONS

This application claims the benefit of U.S. Provisional Application Serial No. 60/421,539, filed Oct. 25, 2002.

STATEMENT REGARDING FEDERALLY SPONSORED RESEARCH OR DEVELOPMENT

Not applicable.

BACKGROUND OF THE INVENTION

This invention relates to an electric open-assist device for a recliner, and more particularly to an electric solenoid open-assist device mounted to a chair recliner mechanism that moves the chair into the reclined position by activating an electric switch.

Conventional recliner chairs are held in the upright position by an over-center locking device. As the user returns the chair ottoman or footrest to the stowed position, the recliner mechanism is moved past the over-center point. Once past this point, the chair will remain in the upright position with the footrest stowed until some force is applied to move the mechanism past the over-center point. A number of different alternatives are currently used for moving into the reclining position. Some chairs are reclined by the user leaning back in the chair while others use a manual handle or lever to move the chair into the reclining position. Both of these motions move the mechanism past the over-center locking point. While these methods can be effective they may also be cumbersome, conspicuous, and inconvenient and thus limit the use of the recliner. For example, a manual handle or lever mechanism may be difficult to operate if the user is elderly, arthritic or a small child. Also, the clearance necessary for a manual handle or lever may also limit the placement of the chair as the handle may not be placed against a wall or next to another piece of furniture. A manual lever or handle may also be aesthetically and ergonomically disadvantageous.

The concept of a manual chair reclining mechanism is known in the art. However, there is a need for an electrically actuated chair reclining mechanism that addresses the above-described drawbacks and deficiencies in existing manual reclining chairs. An electric open-assist device is needed that provides an aesthetically pleasing appearance and that replaces the manual handles and levers used with past chair reclining mechanisms. There is a need for an electrical opening device that alleviates the above-described deficiencies by allowing reclining action with the activation of an electric switch.

BRIEF SUMMARY OF THE INVENTION

In order to overcome the above-stated problems and limitations, the present invention provides an electric chair reclining mechanism that replaces a manual lever or handle.

The present invention further provides an electric chair reclining mechanism where the electric opener is an electric solenoid that can be used with either AC (alternating current) or DC (direct current).

Accordingly, the present invention provides an electric solenoid mounted to a chair recliner mechanism that allows the user to recline the chair with the activation of an electric switch. When the user pushes the electric switch the electric solenoid is energized. The energized electric solenoid moves the linkage system, causing the over-center locking device to unlock. Once unlocked, the reclining mechanism opens due to the weight of the chair occupant, the springs attached to the mechanism, or both. The recliner mechanism is closed in the conventional manner by the user's legs and relocked via the over-center locking device.

Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
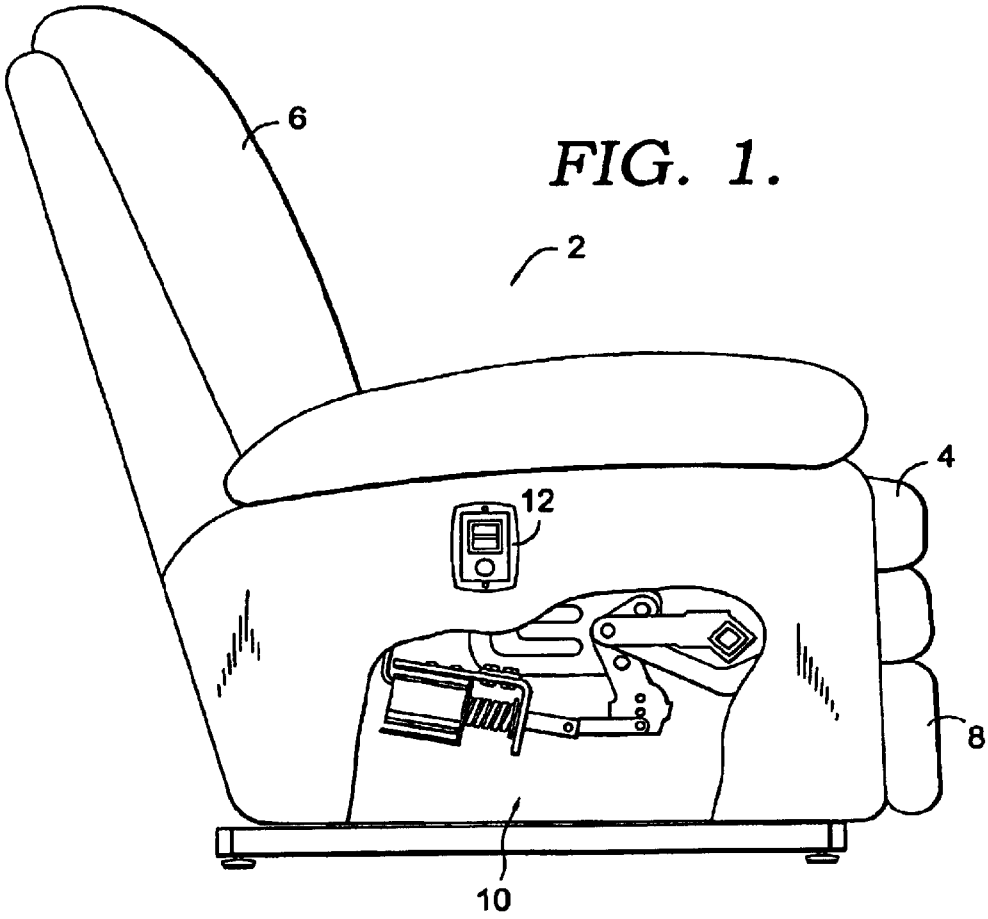
FIG. 1 is a side elevation view of the chair with the reclining mechanism and the electric open-assist device in the unenergized, or locked, recliner mechanism position, with parts broken-away to reveal details of construction.
Figure 2:
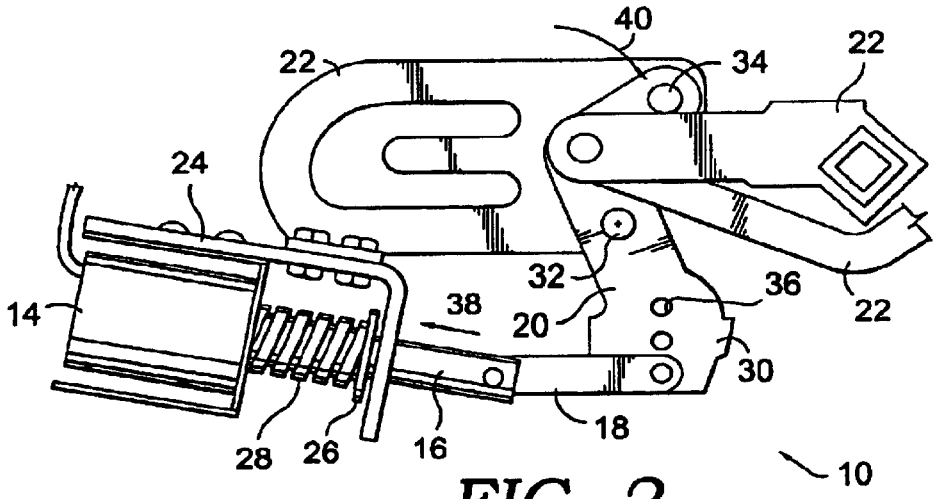
FIG. 2 is a side elevation view of selected components of the chair reclining mechanism in the unenergized, or locked, recliner mechanism position.
Figure 4:
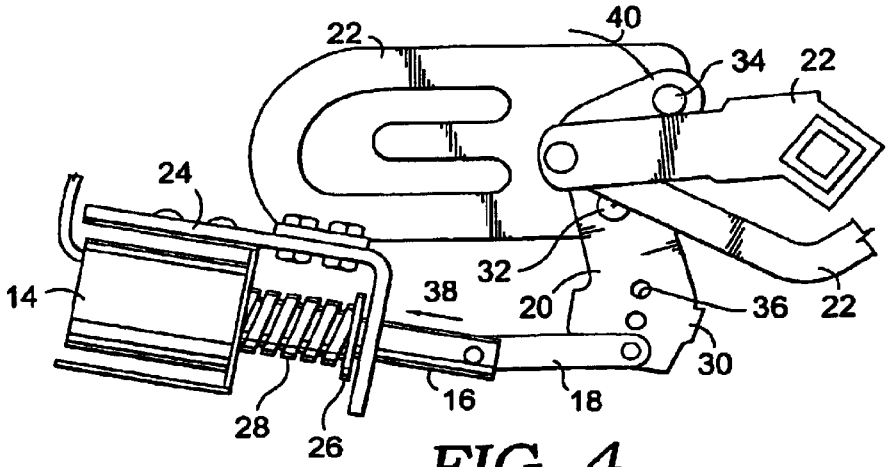
FIG. 4 is a view similar to FIG. 2, but in the energized, or unlocked, recliner mechanism position.

Referring to the drawings in greater detail and initially to FIGS. 1 and 2, a chair with an electric open-assist recliner mechanism is shown and designated generally by the numeral 2. Chair 2 includes a seat 4, back support 6, ottoman 8, and an open-assist device 10. Open-assist device 10 includes an electric switch 12, and as best seen in FIGS. 2 and 4, an electric solenoid 14, a solenoid rod 16, a solenoid connecting link 18, an unlock link 20, and a recliner mechanism 22, which are further described below.

Electric solenoid 14 is fixably coupled to a mounting bracket 24. Electric solenoid 14 is of any type well known in the art and can be used with AC (Alternating Current) and plugged into a standard 120-volt home electrical receptacle. Electric solenoid 14 may also be used with DC (direct current) when a line transformer and rectifier are placed between the AC receptacle and the DC controls. Switch 12 is electrically coupled to solenoid 14 and is used to activate solenoid 14. Switch 12 may be located at any convenient spot on chair 2. Any suitable attachment mechanism could be used for coupling solenoid 14 to mounting bracket 24, such as screws, bolts, pins or the like. Mounting bracket 24 is, in turn, attached to the recliner mechanism 22 and is located so as not to interfere with other parts of the recliner mechanism 22. Electric solenoid 14 has an outwardly-extending solenoid rod 16. Solenoid rod 16 is rotatably coupled to solenoid connecting link 18 on its outer end. Any suitable attachment mechanism allowing this rotation could be used, such as screws, bolts, pins or the like. Solenoid rod 16 has an extending flange 26 generally at its center portion and a rod extending spring 28 disposed around the rod 16. Extending flange 26 maintains rod-extending spring 28 in tension with the housing of electric solenoid 14.

Opposite the connection of rod 16 to link 18, the link 18 is rotatably coupled to unlock link 20. Solenoid connecting link 18 may be formed from stamped steel or any other suitable material known by one skilled in the art. Specifically, links 18 and 20 could also be formed from a flexible steel cable. Solenoid connecting link 18 thus attaches solenoid rod 16 to unlock link 20 and is rotatably coupled to each. Again, any suitable attachment mechanism could be used, such as screws, bolts, pins or the like.

Unlock link 20 is generally L-shaped and includes an attaching end 30, unlock link pivot 32, and a drive arm knob 34. Unlock link 20 is coupled to solenoid connecting link 18 at attaching end 30. Attaching end 30 of unlock link 20 has a series of mounting holes 36 therein which facilitate fastening unlock link 20 to solenoid connecting link 18. Link 20 is pivotally coupled to mechanism 22 at pivot 32. At its upper-end, unlock link 20 is slidably engaged with one component of recliner mechanism 22 at drive arm knob 34. The recliner mechanism component shown is one of the links involved in the over-center locking operation. Drive arm knob 34 is generally cylindrical in nature and extends outwardly from unlock link 20.

While only certain components of the recliner mechanism 22 are shown, it should be understood that the recliner mechanism 22 is one known in the art that is equipped with an over-center locking device. Once the recliner mechanism 22 moves past the over-center locking point, the weight of the chair occupant, or the springs associated with the mechanism 22, or both, operate to move the chair into a reclined position with the ottoman or footrest extended.

Figure 3:
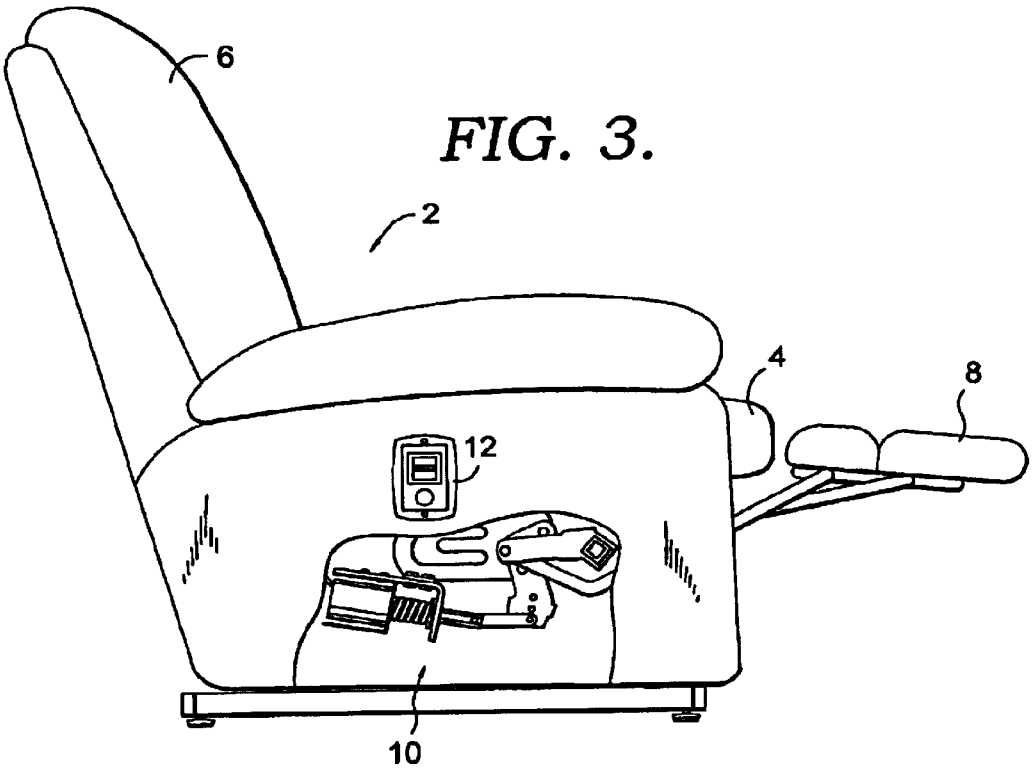
FIG. 3 is a view similar to FIG. 1, but in the energized, or unlocked, recliner mechanism position.

The operation of electric solenoid chair recliner mechanism 10 is best described with reference to FIGS. 1 and 3. FIG. 1 represents the open-assist device 10 in the unenergized or locked recliner mechanism position. FIG. 3 represents the open-assist device 10 in the energized or unlocked recliner mechanism position. In use, if the occupant desires to move from upright to the recline position, the occupant will activate electric switch 12. When switch 12 is activated, electric solenoid 14 is energized. Electric solenoid 14 generates linear motion with solenoid rod 16 and transfers motion to solenoid connecting link 18 in the manner as represented by arrow 38 in FIGS. 2 and 4. Solenoid connecting link 18 engages unlock link 20 and unlocks the over-center locking device contained in recliner mechanism 22.

More specifically, unlocking occurs when energized electric solenoid 14 creates linear motion in solenoid rod 16. Rod extending spring 28 is compressed between flange 26 and housing of electric solenoid 14. As solenoid rod 16 moves, motion is transmitted to solenoid connecting link 18. Solenoid connecting link 18 engages unlock link 20. Unlock link 20 pivots about unlock link pivot 32, creating a downward motion in unlock drive arm knob 34. The downward motion of drive arm knob 34, as represented by arrow 40, engages recliner mechanism 22. More specifically, the knob 34 engages the upper link shown to force it downwardly, as can be seen by comparing FIGS. 2 and 4. The motion of the over-center locking portion of recliner mechanism 22 is similar to the motion caused by the conventional handle. The movement caused by solenoid 14 is only enough to move the recliner mechanism past the over-center locking point. Through the use of the solenoid 14, rod 16 and links 18 and 20, the stroke of rod 16 is enough to move the recliner mechanism past the over-center locking point. Once the over-enter locking device is unlocked, recliner mechanism 22 opens due to either the weight of the chair, or the springs attached to recliner mechanism 22, or both. After recliner mechanism 22 has been unlocked and switch 12 released, solenoid rod 16 is returned to the original position by rod extending spring 28. Reclining mechanism 22 is then closed in the conventional method by the user's legs. The reverse action by the user re-locks recliner mechanism 22, until electric solenoid 14 is again energized.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages which are obvious and inherent in the device. It will be understood that certain features and subcombinations are of utility and may be employed without reference to other features and subcombinations. This is contemplated by and within the scope of the claims. It will be appreciated by persons skilled in the art that the invention is not limited to what has been particularly shown and described hereinabove. Rather, all matter herein set forth or shown in the accompanying drawings is to be interpreted as illustrative and not limiting.

What is claimed is:

1. A chair movable between an upright, stowed position and a reclined, extended position, comprising:

a seat;

a back coupled to the seat;

an ottoman linked to the seat and the back;

a recliner linkage coupling the ottoman to the chair, the recliner linkage adapted to move the ottoman between the upright stowed position and the reclined, extended position, the recliner linkage having a release point, wherein once the recliner linkage moves beyond the release point the chair moves from the upright position to the reclined position; and an electric solenoid driven release mechanism having at least one member in contact with the recliner linkage, wherein activation of the electric solenoid driven release mechanism moves the recliner linkage beyond the release point.

2. The chair of claim 1, wherein said recliner linkage has an over-center locking mechanism that defines the release point.

3. The chair of claim 1, wherein the electric solenoid driven release mechanism includes an electric switch, an electric solenoid electrically coupled to the switch, a rod outwardly extending from the solenoid, a connecting link rotatably coupled to the rod, and an unlock link rotatably coupled to the connecting link, the unlock link being in contact with the recliner linkage.

4. The chair of claim 3, wherein the solenoid is adaptable for use with an alternating current or a direct current.

5. The chair of claim 3, wherein a flange is fixably coupled to the rod and wherein the rod is maintained in tension by a spring contained between the flange and the electric solenoid.

6. The chair of claim 5, wherein the unlock link is generally L-shaped having upper and lower ends, a plurality of mounting holes on the lower end, a pivot point generally midway between the upper and lower ends, and an unlock drive on the upper end.

7. The chair of claim 6, wherein the unlock drive consists of an outwardly-extending protrusion slidably engaged with the recliner linkage.

8. The chair of claim 7, wherein the unlock link rotates about the pivot point to slidably engage the protrusion to move the recliner linkage past the release point.

9. A release mechanism for a reclining chair having a reclining mechanism operable to extend an ottoman, the reclining mechanism having a defined release point where, once past the release point, the reclining mechanism positions the chair from an upright to a reclined position and where, once retracted beyond the release point, the reclining mechanism maintains the chair in an upright position comprising:

a switch;

a solenoid coupled to the switch, the solenoid having an outwardly extending rod; and a connecting linkage having first and second ends, the first end rotatably coupled to the rod, the second end in contacting relationship with a portion of the reclining mechanism, wherein the activation of the solenoid operates to move the connecting linkage to move the reclining mechanism beyond the release point.

10. The mechanism of claim 9, wherein said release point is defined by an over-center locking type mechanism on the reclining mechanism.

11. The mechanism of claim 9, wherein a flange is fixably coupled to the rod and wherein the rod is maintained in tension by a spring contained between the flange and the solenoid.

12. The mechanism of claim 11, wherein the connecting linkage includes a connecting link rotatably coupled to the rod on one end and an unlock link rotatably coupled to the other end of the connecting link.

13. The mechanism of claim 12, wherein the unlock link is generally L-shaped having upper and lower ends, a plurality of mounting holes on the lower end, a pivot point generally midway between the upper and lower ends, and an unlock drive on the upper end.

14. The mechanism of claim 13, wherein the unlock drive consists of an outwardly-extending protrusion slidably engaged with the reclining mechanism.

15. The mechanism of claim 14, wherein the unlock link rotates about the pivot point to slidably engage the protrusion to move reclining mechanism past the release point.

16. The mechanism of claim 15, wherein the solenoid is an electric solenoid.

* * * * *